US005500951A

United States Patent [19]

Marchello

[11] Patent Number: 5,500,951

[45] Date of Patent: Mar. 26, 1996

[54] SHOCK ABSORBING STRAP COVER

[75] Inventor: John L. Marchello, Ann Arbor, Mich.

[73] Assignee: Danmar Products, Inc., Ann Arbor, Mich.

[21] Appl. No.: 209,401

[22] Filed: Mar. 14, 1994

[51] Int. Cl.[6] ..... A41D 13/00; A42B 3/08

[52] U.S. Cl. ..... 2/2; 2/421; 2/425

[58] Field of Search ..... 2/2, 9, 260, 267, 2/268, 411, 421, 424, 425, 410; 450/86; 224/264; 297/482, 468, 488; 280/805, 801.1

[56] References Cited

U.S. PATENT DOCUMENTS

| | | | |
|---|---|---|---|
| 980,421 | 1/1911 | Jordan | 2/2 |
| 1,055,077 | 3/1913 | Quirk | 2/2 |
| 2,274,652 | 3/1942 | Bayon . | |
| 2,513,886 | 7/1950 | Mix . | |
| 2,643,380 | 6/1953 | Blair | 2/2 |
| 2,676,737 | 4/1954 | Zirbel | 2/2 |
| 2,763,004 | 9/1956 | Sanders | 2/2 |
| 2,765,469 | 10/1956 | King | 2/2 |
| 3,052,886 | 9/1962 | White | 2/2 |
| 3,883,053 | 5/1975 | Pritchard et al. . | |
| 3,945,042 | 3/1976 | Lobo | 2/2 |
| 4,484,364 | 11/1984 | Mitchell et al. | 2/413 |
| 4,887,318 | 12/1989 | Weinreb | 2/268 |
| 4,999,980 | 3/1991 | McGowan . | |
| 5,250,345 | 10/1993 | Chu | 2/268 |

*Primary Examiner*—Michael A. Neas
*Attorney, Agent, or Firm*—Harness, Dickey & Pierce

[57] ABSTRACT

A shock absorbing strap cover is made of a resilient pad having a mounting portion for mounting the strap cover to a strap. The pad includes surfaces defining contact face on one side and a non-contact face on the opposing side. The non-contact face faces toward the strap and the contact face faces away from the strap when the strap cover is mounted thereon. The pad is made up of cushion members that are located side-by-side to one another. The cushion members are compressible and cushion any loads applied through the strap.

7 Claims, 1 Drawing Sheet

SHOCK ABSORBING STRAP COVER

BACKGROUND AND SUMMARY OF THE INVENTION

The invention generally relates to covers used with straps and more particularly relates to strap covers which also provide cushioning to the user.

Straps of numerous varieties and for many purposes have been used or proposed. Generally, straps, as that term is used herein, are generally wide, flat band-like structures that support an object secured to its opposing ends and that are positioned over a shoulder, around the neck or under the chin of a user or wearer. Some common items which utilize straps include, purses, carry-on bags, gym bags, cameras, camera bags, binoculars, knapsacks, backpacks, golf bags, eye glasses and various types of head wear including the protective headgear used in football, wrestling, boxing, bicycle riding and motorcycle riding. Obviously, this list only intended to illustrate the numerous uses for straps and in no way is it intended to limit the present invention which is further discussed below.

While some of these straps are merely webbed bands of nylon or other materials, other straps are padded to increase the comfort associated with use the strap. Padded straps, such as golf bag straps, are typically padded by incorporating a resilient material, such as foam or sponge rubber, into that portion of the strap in contact with the user's body. While the padded cover often consists of a single layer of the material directly incorporated into the strap, another variety of padded cover is slipped over and movable along the strap. Unfortunately, the resilience of sponge rubber deteriorates quickly with usage and the slip on type of padded covers have a tendency to turn, roll or slide on the strap out of its intended position.

Inflatable cushions have also been proposed for use as strap covers. Typically, the inflatable pad is attached to the strap by slipping the strap through a portion of the pad or by some other mounting feature. Obviously, inflatable pads are limited in their use because of their suspect durability. For example, once the inflatable pad has been punctured, it is useless until it is either repaired or replaced. Also, inflatable pads require manual inflation and are susceptible to valve failure, two further drawbacks.

With the limitations of the prior art in mind, it is therefore one object of this invention to provide a shock absorbing strap cover capable of being used with a wide variety of straps that themselves may be intended for numerous different purposes.

Another object of this invention is to provide a strap cover which has individually contained load or shock absorbing elements.

Another object of this invention is to provide a strap cover which utilizes a simplified construction that is an effective mechanism for absorbing, cushioning or distributing the loads imposed by a strap.

Still another object of this invention is to provide a shock absorbing strap cover which is easily used with straps not originally having any cushioning mechanisms.

A further object of this invention is to provide a shock absorbing strap cover having elements which individually respond to a load applied through the strap and which collectively distribute the load evenly about the area in contact with the user's body.

Yet another object of this invention is to provide a strap cover which incorporates features that provide for ventilation and which help to draw perspiration away from both the user and the strap.

In achieving the above objects, the present invention provides a shock absorbing strap cover comprised of a resilient pad and a portion for mounting the pad to the strap. The portion which mounts the cover to the strap is a receiving channel or pocket, defined on one side by the pad itself and on the opposing side by a web whose lateral sides are secured to the lateral sides of the pad. This construction allows the strap to be inserted through the channel and allows the cover to be moved relative to the strap into any desired position therealong. The pad itself is further made up of a series of side-by-side, soft resilient elements. Each element is generally a hollow cylinder that is open at both of its ends. The cylindrical shape of these open ended elements, as well as the inherent resiliency of the plastic material from which they are formed, permits the elements to individually deflect and deform in response to an applied load. This individual deflection results in the strap cover being better able to respond to the application of the load and increases the comfort associated with its use.

The resilient elements cooperate to define a contact face and a non-contact face on the pad. The contact face is the face on that side of the pad which is to contact the user. The non-contact face engages the strap. Since the pad is constructed out a series of cylindrical elements, a number of recesses, which extend the length of the strap cover, are defined in the contact face. These recesses operate as ventilation channels which draw away perspiration from both the person and the strap. This feature is particularly desirable in those situations where the strap cover is used with athletic equipment.

During athletic events and particularly when athletic equipment is commonly shared, it is possible for bacteria and viruses to be transferred between participants. It is therefore recommended that good hygiene be practiced before and after the competition or practice. This involves not only the personal hygiene of the athletes, but also the cleaning of equipment which can collect and trap perspiration, as well as bacteria and viruses. With the present invention, this recommended hygiene is easily accomplished since the strap cover is readily removable from the strap for thorough cleaning.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
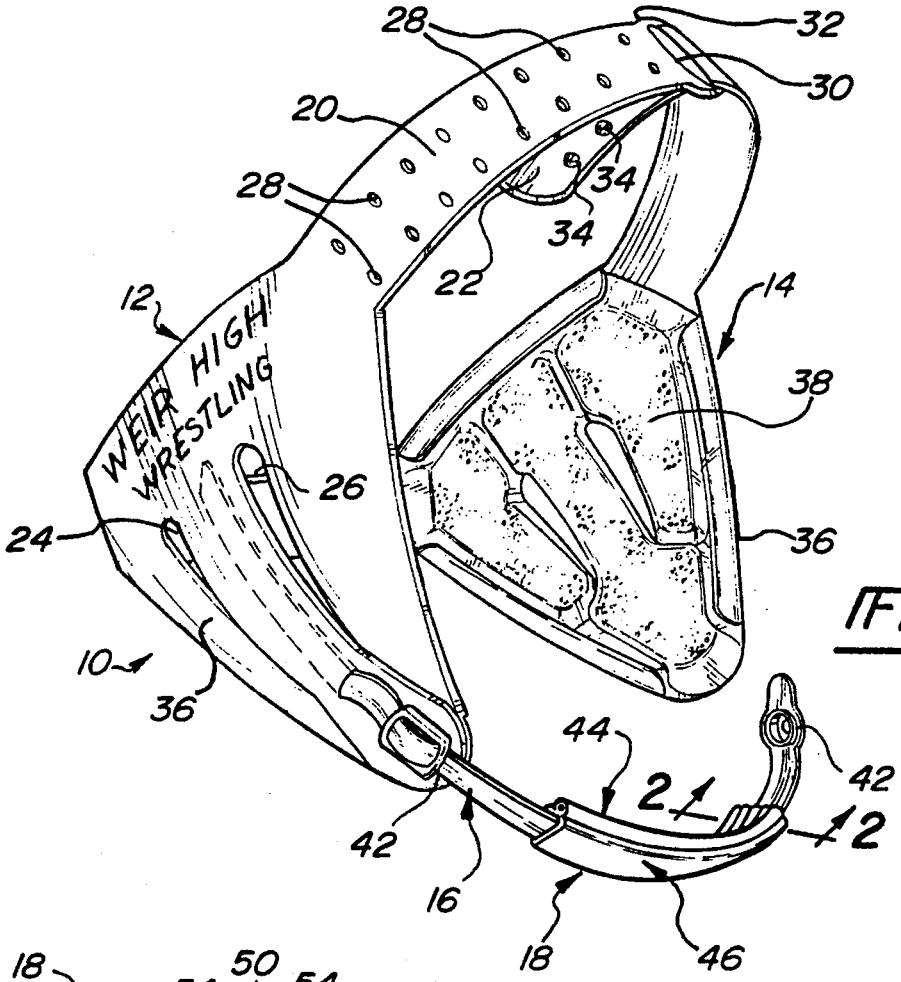
FIG. 1 is a perspective view of a piece of athletic equipment, more specifically headgear for wrestling, in which one embodiment of a strap cover according to the present invention is mounted to the chin strap associated therewith.

Referring now to the drawing, an athletic earguard and more specifically the headgear used during wrestling is shown in FIG. 1 and generally designated at 10. The headgear 10 is principally constructed from a pair of side panels 12 and 14 provided with a chin strap 16. A strap cover 18 embodying the principles of the present invention is mounted to the chin strap 16. Before describing the strap cover 16 in detail, it is believed that a brief discussion of the headgear 10 would be beneficial.

As mentioned above, the headgear 10 includes a pair of side panels 12 and 14 which are designated as the right side panel 12 and left side panel 14. The side panels 12 and 14 are substantially flat sheets of injection molded plastic which are formed with integral front head straps 20 and 22 and rear head straps 24 and 26, respectively. The front and rear head straps 20 and 24 of the right side panel 12 include a series of evenly spaced holes 28 along their lengths and an elongated transverse slot 30 at their ends. The elongated slots 30 extend transversely to the length of the straps 20 and 24 in an enlarged end portion 32. These end portions 32 have an enlarged width which enables the slots 30 to be formed with a length that is greater than the width of the straps 22 and 26 themselves.

The side panels 12 and 14 are assembled together by feeding the straps 22 and 26 of the left side panel 14 through to the slots 30 in the right side panels 12. The straps 22 and 26 of the left side panel 14 are each provided with four raised studs 34 that are directed to face the straps 20 and 24. The size of the studs 34 allows them to snap-fit into the holes 28 of straps 20 and 24 and thereby permits the size of the headgear 10 to be readily adjusted through the appropriate selection of the holes 30 into which the raised studs 34 are inserted.

Each side panel 12 and 14 includes a cup section 36 which covers the ears of the wearer. The cup section 36 is configured to receive and retain an ear pad 38 generally on the interior or concave side of the cup section, so that, when worn it will contact and fully extend over the wearer's ear. The ear pad 38 is molded from a soft, resilient, vinyl/rubber compound, generally has a triangular shape that allows it to be inserted and removed from the cup section 36.

The cup sections 36 are provided with one half of a snap fastener on their lowermost exterior surfaces. The snap fasteners enable a chin strap 40, having halves 42 complementary to the snap fasteners, to be mounted to and extend between the side panels 12 and 14. The chin strap 40 retains the headgear 10 on the head of the wearer by extending beneath the wearer's chin. As mentioned above, the chin strap 40 is generally a flat band-like structure to which the strap cover 18 of the present invention is mounted between the snap fasteners 42 on the ends of the chin strap 40.

The strap cover 18 includes a shock absorbing pad 44 and a web 46. The pad 44 cushions the load applied through the strap 16 and the web 46 mounts the strap cover 18 to the chin strap 16. The resilient pad 44 and web 46 are unitarily formed with one another from a soft, resilient vinyl, rubber, plastic or other compound which provide the desired shock absorbing attributes as further described herein. Depending on the particular compound used for forming the strap cover 18, it may be manufactured by various techniques including compression molding, injection molding or extrusion.

Figure 2:
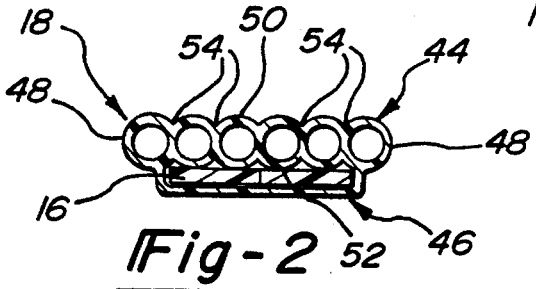
FIG. 2 is a cross sectional view taken substantially along line 2—2 in FIG. 1.
Figure 3:
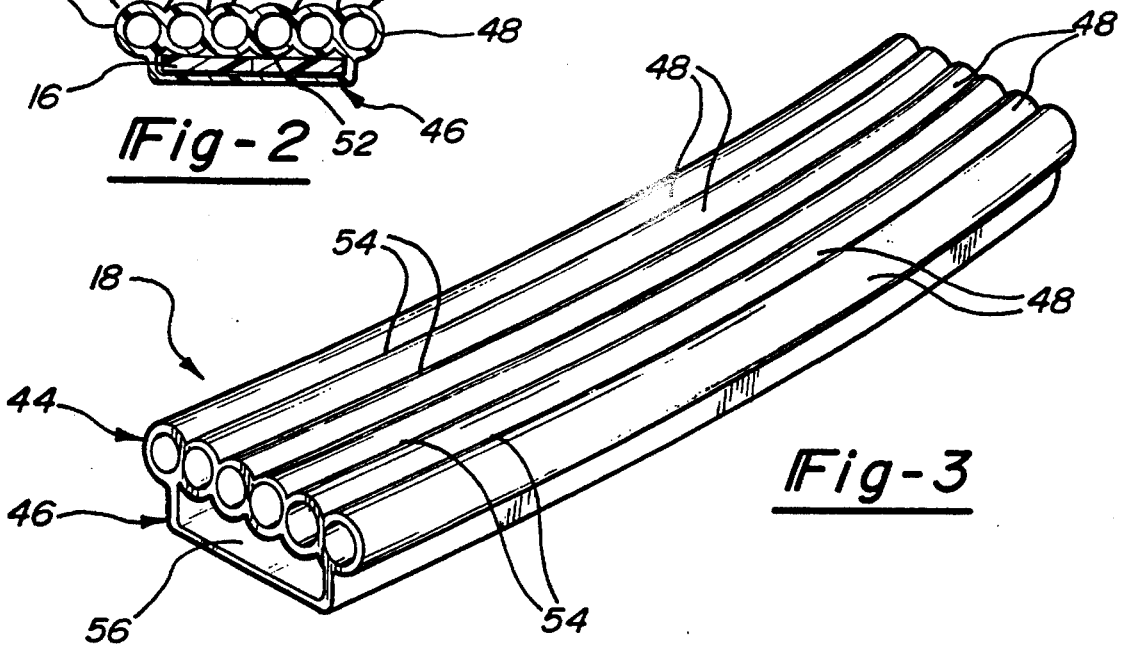
FIG. 3 is a perspective view of a strap cover incorporating the principles of this invention.

The resilient pad 44 includes a series of individual cushioning elements or cells 48 which are positioned substantially side-by-side to one another. While not specifically required, it is preferred that the number and size of cells 48 cooperate to ensure the strap cover 18 has a width that is equal to or greater than that of the strap 16. The cells 48 themselves are hollow cylinders or tube-like structures that longitudinally extend along a portion of length of the strap 16. While it is preferred that the cells 48 extend longitudinally with the length of the strap 16, if desired they could be transversely oriented without significantly compromising the operability of the strap cover 18. The cells 48 cooperate with one another to define opposing faces herein referred to as a contact face 50 and a non-contact face 52. As seen in FIG. 2, the non-contact face 52 is directed toward the strap 16 while the contact face 50 is generally directed so that it will physically contact the wearer of the headgear 10 or, in other use situations, the user of the strap 16. Since the cells 48 are tube-like or cylindrical, a recess 54 is defined in both faces 54 and 52 where adjacent cells 48 intersect and merge with one another. These recesses 54 extend the length of the strap cover 18 to provide a ventilation channel and a mechanism by which perspiration can be drawn away from the wearer and the strap 16.

The web 46 mentioned above extends away from one of the lateral cells 48 to the opposing lateral cell 48 thereby defining a passageway 56 between the web 46 and the non-contact face 52 through which the strap 16 can be inserted.

When the strap cover 18 is properly mounted to the strap 16, the strap 16 will extend through the passageway 56 defined between the non-contact face 52 and the web 46 and the pad 44 will be positioned between the strap 16 and the user. Depending on the size of the strap 16 with which it is intended to be used, the strap cover 18 can be manufactured so that the passageway 56 has a corresponding width and height. For example, a narrower strap cover 18 and passageway 56 may be warranted when the strap cover 18 is intended for use with a binocular strap. Similarly, a wide passageway 56 and strap cover 18 would be necessary for use with a golf bag strap. Frictional contact between the strap 16 and the strap cover 18, as well as the width and height of the passageway 56 corresponding to the strap 16, prevents the strap cover 18 from readily sliding along the strap 16 during use and allows the strap cover 18 to be positioned as desired along the length of the strap 16.

Each cell 48 operates as an individual shock absorbing element which can respond to the application of a load through the strap 16. The generally annular cross-sectional construction of each cell 48, along with the resilient nature of the material from which it is formed, allows the cells 48 to absorb any load which they encounter. The combined resilience and softness of the material from which the cells 48 are constructed allows the pad 44 to readily conform to the shape of that portion of the user's body which it is to contact. The soft resilient nature of the strap cover 18 also enhances the comfort of the wearer or user by preventing the strap 16 from directly bearing against and "digging" into the wearer. However, since the cells 48 are longitudinally connected to adjacent cells 48, upon one cell 48 being deflected, the adjacent cells 48 will also partially deflect. In this manner, the load will be dispersed over a wide area. A greater or lesser amount of shock absorbency can be accomplished by varying the reliancy of the material, altering the diameter of each cell 48 as well as changing the wall thickness of each cell 48. The open ends of each cell 48 prevents the cell 48 from experiencing the limited deflection normally associated with the use of air chambers as are typically found in the inflatable type of cushioning members mentioned above.

While the above description constitutes the preferred embodiment of the present invention, it will be appreciated that the invention is susceptible to modification, variation and change without departing from the proper scope and fair meaning of the accompanying claims.

What is claimed is:

1. A shock absorbing cover for a chin strap for placement under the chin of a,wearer, said strap cover comprising:

a cushioned pad and mounting means for mounting said pad to a chin strap, said pad including a surface defining a contact face on one side of said pad and facing away from the strap when said strap cover is mounted thereto for engagement with the skin of the wearer, said pad also including a surface defining a non-contact face on the opposing side of said pad facing toward the strap when said strap cover is mounted thereto, said pad further including a plurality of individually resilient cylindrical elements located in side-by-side joined relation to one another and cooperating to define said contact face and said non-contact face, said resilient elements being hollow and capable of individually compressing in a direction between said contact face and said non-contact face in response to a load applied through the strap, said resilient elements being resiliently biased to resist the load and thereby cushion the load applied through the strap, said resilient cylindrical elements having a longitudinal direction extending parallel to the chin strap and extending the length of said pad, the cylindrical shape of said resilient elements forming ventilation channels extending the length of the cover in said contact face enabling air and perspiration to be drawn therethrough and away from the skin of the wearer of said strap cover.

2. A shock absorbing strap cover as set forth in claim 1 wherein said resilient cylindrical elements are unitarily formed with each other and joined together along adjacent longitudinal sides thereof.

3. A shock absorbing strap cover as set forth in claim 1 wherein said resilient elements are open at both ends and hollow therethrough.

4. A shock absorbing strap cover as set forth in claim 1 wherein said resilient elements are constructed of resilient plastic.

5. A shock absorbing strap cover as set forth in claim 1 wherein said pad includes opposing longitudinal sides and wherein said mounting means includes a web adapted to extend around the strap and generally secure said strap cover thereto, said web extending from one longitudinal side of said pad to the other of said longitudinal sides and cooperating with said non-contact face to define a passageway adapted to receive the strap therethrough.

6. A shock absorbing strap cover as set forth in claim 5 wherein said web is unitarily formed with said pad.

7. A unitarily formed shock absorbing cover of resilient plastic for a chin strap for placement under the chin of a wearer, said strap cover comprising:

a cushioned pad and mounting means for mounting said pad to a strap, said pad including a surface defining a contact face on one side of said pad and facing away from the strap when said strap cover is mounted thereto for engagement with the skin of the wearer, said pad also including a surface defining a non-contact face on the opposing side of said pad facing toward the strap when said strap cover is mounted thereto, said pad further including a plurality of individually resilient, substantially parallel, cylindrical tubes having a length and being located in side-by-side relation to one another such that said length of said tubes extends generally along the length of the cover, said tubes being unitarily formed with one another and joined together along longitudinally adjacent sides thereby defining said contact face and said non-contact face, said tubes being hollow and capable of individually compressing in a direction between said contact face and said non-contact face in response to a load applied through the strap, said tubes being resiliently biased to resist the load and thereby cushion the load applied through the strap, portions of said tubes cooperating to define longitudinal recesses in said contact face between each adjacent tube, said recesses being located in side-by-side relation to one another and extending the length of said pad, said recesses forming ventilation channels enabling air and perspiration to be drawn therethrough and away from the skin of the wearer of said strap cover; and said mounting means including a web adapted to extend around the strap and generally secured said pad thereto, said web extending from one lateral side of said pad to the other lateral side of said pad and cooperating with said non-contact face to define a passageway adapted to receive the strap therethrough.

* * * * *